US006488425B1

(12) United States Patent
Spence et al.

(10) Patent No.: US 6,488,425 B1
(45) Date of Patent: Dec. 3, 2002

(54) PORTABLE ELECTRONICS DEVICE HAVING KEYPAD AND REMOVABLE BEZEL

(75) Inventors: Gary D. Spence, Mendon, UT (US); Jeffery D. Ricks, Logan, UT (US)

(73) Assignee: Juniper Systems, Inc., Logan, UT (US)

( * ) Notice: Subject to any disclaimer, the term of this patent is extended or adjusted under 35 U.S.C. 154(b) by 71 days.

(21) Appl. No.: 09/685,120

(22) Filed: Oct. 10, 2000

(51) Int. Cl.[7] ..... H01H 13/06; B41J 29/12

(52) U.S. Cl. ..... 400/714; 400/88; 400/472; 200/302.2; 200/512; 341/22; 345/169; 379/451

(58) Field of Search ..... 400/88, 472, 713, 400/714, 479; 200/5 A, 5 R, 302.1, 302.2, 512; 379/447, 451, 452; 341/22; 345/168, 169; 361/680; 235/145 R

(56) References Cited

U.S. PATENT DOCUMENTS 4,075,465 A * 2/1978 Funk et al. ..... 200/309
4,555,600 A * 11/1985 Morse ..... 200/302.2
4,621,373 A * 11/1986 Hodsdon ..... 200/5 A
5,219,067 A * 6/1993 Lima et al. ..... 200/302.2
6,172,620 B1 * 1/2001 Brick et al. ..... 200/302.1
6,180,895 B1 * 1/2001 Hutchinson et al. ..... 200/314

* cited by examiner

*Primary Examiner*—Leslie J. Evanisko
(74) *Attorney, Agent, or Firm*—R. Burns Israelsen; Workman, Nydegger & Seeley

(57) ABSTRACT

An electronics device having a removable bezel to facilitate cleaning of a keypad structure. The electronics device includes a housing that defines and encloses an interior of the electronics device. Keys included in a keypad structure are formed on a surface of the housing in a manner such that spaces may exist between the keys and the housing. A pliable structure is positioned over and substantially conforms to the keys and the adjacent portions of the housing so as to cover the opening near the keys and to further seal the housing. A removable bezel covers the keypad structure, including at least a portion of the pliable structure. The bezel has openings through which the keys extend, permitting users to depress keys while the bezel is positioned on the electronics device. The bezel, in combination with the keys, provides a keypad surface that enables users to conveniently enter information into the electronics device. In response, for example, to water, dirt, or dust being exposed to the electronics device, the bezel can be removed to allow access to the keys and the pliable structure, which can then be cleaned as needed.

13 Claims, 7 Drawing Sheets

PORTABLE ELECTRONICS DEVICE HAVING KEYPAD AND REMOVABLE BEZEL

BACKGROUND OF THE INVENTION

1. The Field of the Invention

The present invention relates to portable electronics devices, such as handheld computers. Specifically, the present invention relates to removable bezels that can be selectively removed from a keypad structure of the portable electronics device so as to facilitate convenient cleaning of the electronics device.

2. The Prior State of the Art

During recent decades, electronics devices have become smaller, more lightweight, and more widely used in a variety of industries and endeavors. Early computers used vacuum tubes and other large-scale components and, accordingly, were large devices that were immovable fixtures and at times could fill an entire room. With the advent of liquid crystal display devices, integrated circuits and silicon semiconductor chips, computers and other electronics devices have steadily increased in computing power and decreased in size.

In recent years, the demand for access to computing power, coupled with the significant decrease in computer size has yielded portable electronics devices, such as laptop computers, which enable users to carry computing resources that previously were limited to relatively fixed, desktop computers. Special-purpose computing and communication devices have also been developed, including digital personal assistants, cellular phones, global positioning system receivers, and any number of other electronics devices.

This proliferation has taken computers and electronics devices from the relatively sterile conditions of the laboratory and the office to environments and industries where the devices are more likely to experience dirty or adverse conditions, including transportation environments, manufacturing, agriculture, natural resource industries, etc. Some electronics devices have been designed specifically for use outdoors and in other dirty or unpredictable environments. These devices are typically rugged, and can withstand some amount of vibration and shock, dust, dirt, and exposure to water or foreign material.

Most rugged electronics devices include keyboards or other keypad structures that enable users to input information or to manipulate the information displayed on a display device. Practically all keypads share a common feature of movable keys that are depressed by the user to input information. The interface between the movable keys and the fixed housing of the electronics devices causes dirt to accumulate, which can eventually interfere with the operation of the keys or other parts of the device. Moreover, there are often gaps or spaces between movable keys and the housing that can allow water, dust, or dirt to enter the interior of an electronics device. Lettering and/or numbering is also typically printed or formed on keypad structures, on or near the keys. Providing surfaces on which lettering and numbering can be printed increases the complexity of the keypad structure, thereby further complicating the process of cleaning the device. In addition, the need to clearly view lettering and numbering on keypad structures increases the importance of providing devices that can be conveniently cleaned when they become dirty.

Conventional portable electronics devices often have keypad structures that are difficult to clean. The movable keys and the associated housing sometimes represent the weak link that prevents electronics devices from being fully resistant to water, dust, and other adverse environmental conditions. This problem is made more serious by the increasing demand for rugged electronics devices that allow computing resources to be accessed in any environment.

SUMMARY OF THE INVENTION

The present invention relates to a removable bezel assembly associated with a keypad structure for use with electronics devices, particularly portable devices that are intended to be used in environments where exposure water, dust, dirt, or other adverse conditions can be expected. The bezel is removable so as to permit convenient cleaning of both the bezel and the keypad structure with which it is associated.

According to one aspect of the invention, an electronics device, such as a handheld computer or another portable electronics device, has a set of keys arrayed on a keypad structure. The keys can be depressed by users to allow the users to input information. In order to cause the electronics device to withstand exposure to dust, dirt, or the like, the movable keys of the keypad structure and the housing in which they are arrayed are covered with a pliable protective structure, such as one formed from a polymeric material. The pliable protective structure substantially conforms to the housing and the keys in a manner such that users can distinguish individual keys and can depress the keys by pushing on the surface of the pliable material situated atop the ends of the keys.

A removable bezel, typically formed from a substantially rigid material, is removably positioned over the housing and the polymeric material over the region of the display device associated with the keypad structure. The bezel has openings formed therethrough, and the openings are arrayed on the bezel to align with the keys when the bezel is positioned on the electronics device. When the bezel is in position, the keys extend through the openings and can be accessed by the user. The bezel, in combination with the keys, presents the user with a keypad surface that enables the user to conveniently depress keys and input information. Lettering and/or numbering can be formed on either the keys, the bezel, or both.

During normal operation of the electronics device, the bezel is in position on the housing. As the electronics device is used and exposed to conditions where dust or dirt is present, the dust or dirt can accumulate on the exposed surface of the bezel, on the exposed keys, on the backside of the bezel, and on the pliable protective structure under the bezel. The conforming nature of the polymeric material substantially prevents dirt, water, or other foreign materials from entering the inside of the housing through the keypad structure.

The keypad structure, along with the remaining portions of the electronics device, can be cleaned by removing the removable bezel from the housing. The front surface, the back surface, and the openings of the bezel can be cleaned when it has been removed from the housing. Removing the bezel also exposes the pliable protective structure conforming to the keys and the housing so that it can also be conveniently cleaned. After cleaning, the bezel can be repositioned so that the electronics device can be used again.

The removable bezel of the invention facilitates cleaning of electronics devices in ways that have not been possible in the prior art. Moreover, the use of the bezel in combination with the pliable protective structure that covers and conforms to the keys and the housing prevents water, dirt, or dust from entering the housing in the spaces that would otherwise exist between the keys and the housing in the absence of the invention. Thus, the present invention can prolong the use of electronics devices in adverse environments and can make existing electronics devices more adaptable to any desired conditions.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawing depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention relates to electronic devices having housings with selectively removable bezels that can be removed to provide access to a keypad structure for cleaning. The removable bezel is positioned generally over the keypad structure when attached to the housing and has holes through which keys of the keypad structure can be depressed by a user. When dirt, dust, water, or the like, is exposed to the electronics device, the bezel can be removed so that the interior of the keypad structure, as well as the bezel, can be cleaned. In this manner, the keypad structure of the electronics device can be kept free of dirt or other material that could otherwise interfere with its operation.

The removable bezel assemblies of the invention are described herein in the context of a handheld, portable computer. The handheld computer specifically disclosed herein represents handheld electronics devices in which the invention can be practiced. The removable bezel assembly can exist with or without the other novel features described in reference to the portable computer. An electronics device that has the removable bezel assembly disclosed herein can be conveniently cleaned when the electronics device becomes dirty. When combined with the other features disclosed herein, an electronics device with the removable bezel can be comfortably held for long periods and can withstand harsh environmental conditions in other ways.

Figure 1:
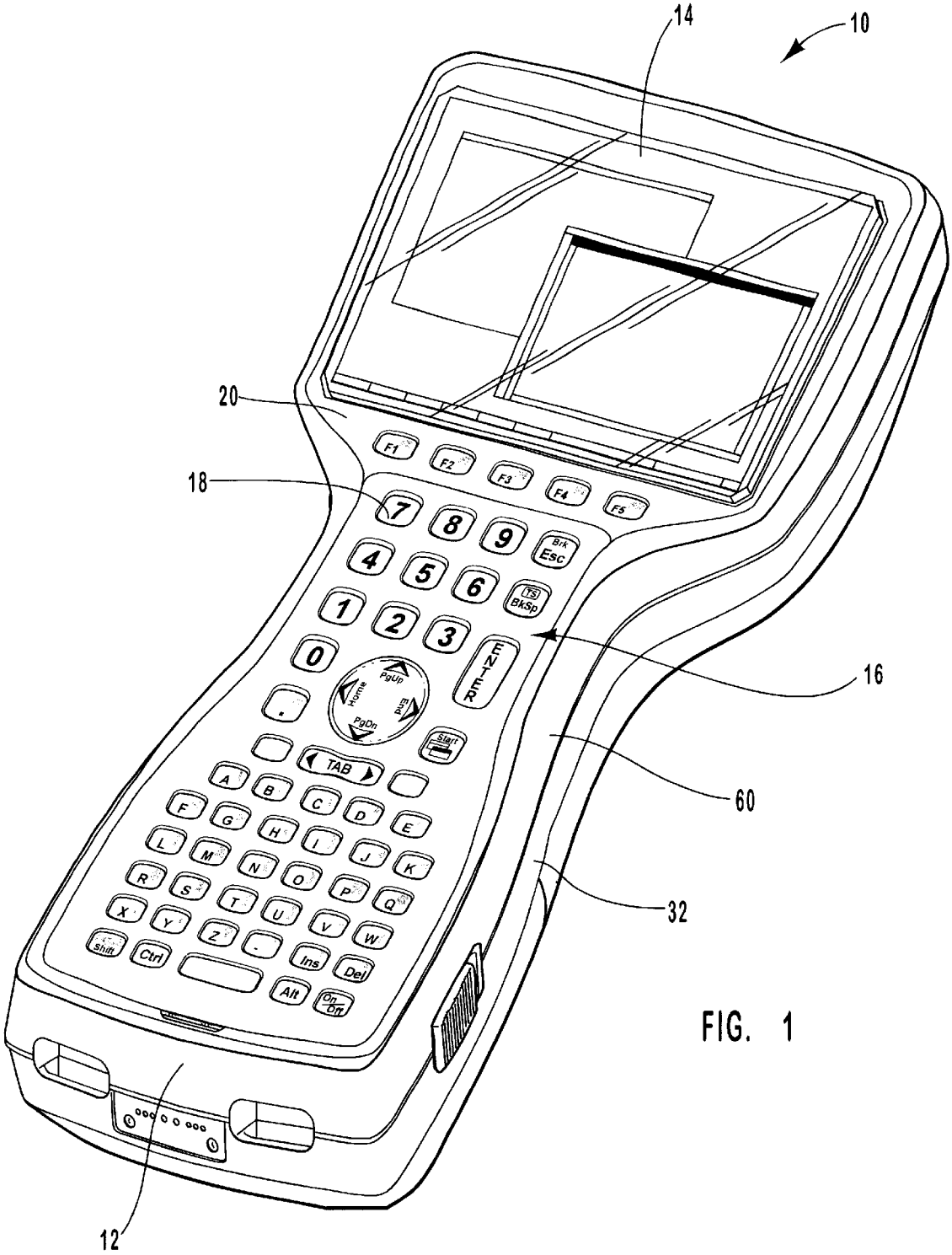
FIG. 1 is a perspective view of a handheld computer that includes a removable bezel according to the invention.

FIG. 1 is a perspective view of a handheld computer having the bezel that can be selectively removed according to one embodiment of the invention. The computer 10 has a housing 12 that encases the processing components of the computer and protects the computer from environmental conditions. Housing 12 is an example of housing means for defining and enclosing an interior of an electronics device. Computer 10 has a display device, the screen of which is shown in FIG. 1 at reference number 14. A keypad structure 16 with alphanumeric keys 18 is positioned on the front surface 20 of housing 12, and represents an example of key means for generating input to an electronics device upon being manipulated by a user. Computer 10 has a removable bezel that will be disclosed in greater detail below.

1. Removable Bezel

Figure 2:
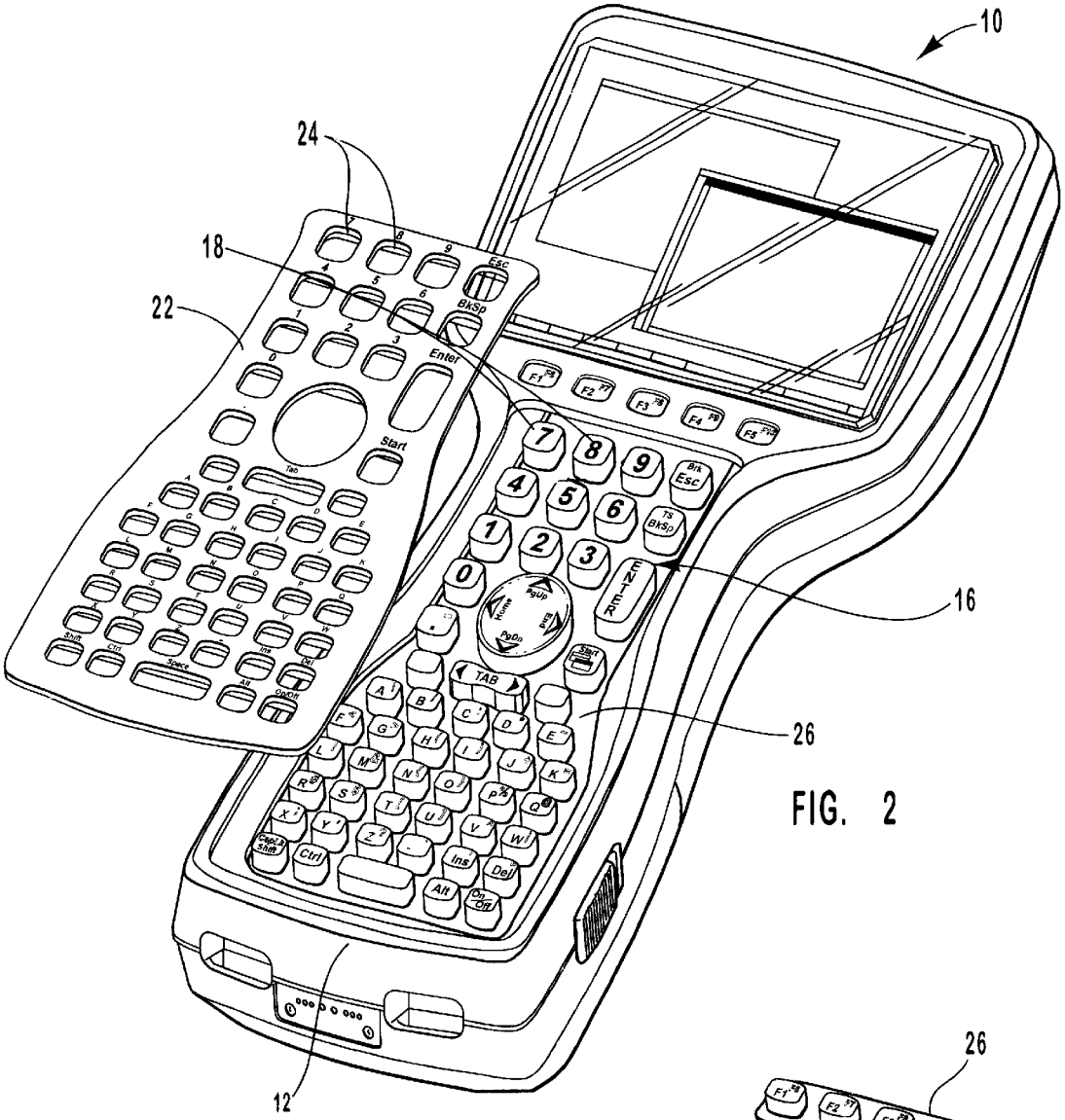
FIG. 2 illustrates the bezel of the handheld computer of FIG. 1 having been removed from the keypad structure to facilitate cleaning of various portions of the computer.

A removable bezel that facilitates the cleaning of the keypad structure of computer 10 of FIG. 1 is illustrated in greater detail in FIG. 2. Bezel 22 is illustrated in FIG. 2 as having been removed from housing 12. When positioned on housing 12, bezel 22 is snap-fitted or otherwise removably attached to front surface 20 of housing 12 generally over keypad structure 16. Bezel 22 has an array of holes 24 that are in registry with the corresponding keys 18 of keypad structure 16, such that when the bezel is positioned on housing 12, the keys 18 extend through the corresponding holes 24. With bezel 22 positioned on housing 12, keys 18 are accessible and keypad structure 16 can be used in a normal manner to input data to computer 10. The front surface of bezel 22 and the exposed portion of keys 18 represent a keypad surface to which the user can input data. Lettering and/or numbering can be printed on bezel 22, on keys 18, or both. In the embodiment illustrated in FIG. 2, bezel 22 is a substantially rigid structure formed of a polymeric material or another material that is readily cleaned.

A removable bezel assembly illustrated in FIG. 2 is particularly useful where computer 10 is used in environments where exposure to water, dust, dirt, or other adverse conditions can be expected. Bezel 22 is removable to allow both the front and back surfaces of the bezel to be cleaned when it is exposed to dust, dirt, or other adverse environmental conditions. Moreover, removing bezel 22 from computer 10 allows the keypad structure 16 to be conveniently cleaned. While removable bezel 22 can be attached to housing 12 in substantially any manner, constructing bezel 22 such that it can be removed manually and without tools can be advantageous in many situations.

Figure 3:
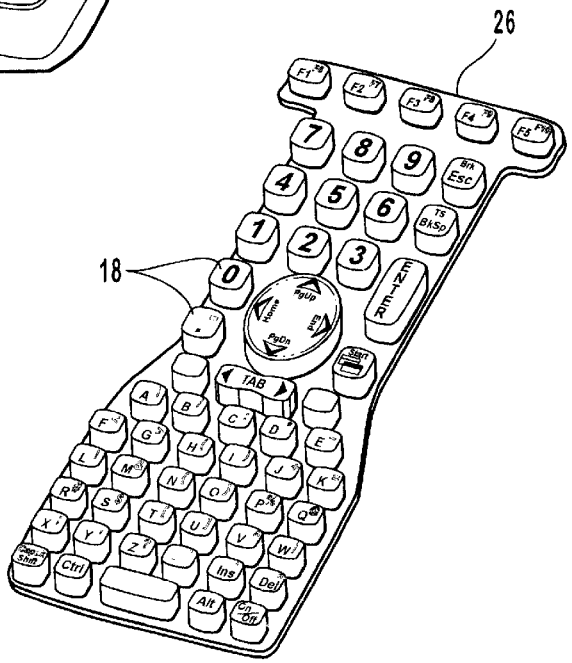
FIG. 3 illustrates a portion of a pliable protective structure that conforms to the keypad structure of the handheld computer.

In this embodiment, keypad structure 16 includes a pliable protective structure 26, shown in both FIGS. 2 and 3, formed from a polymeric material that conforms to keys 18 and to housing 12 in a manner that seals the interior of housing 12 and also presents a surface with relatively few intricacies for cleaning. The periphery of pliable protective structure 26 is sealingly fitted against the inside surface of housing 12 to prevent water or other material from entering the interior of the housing. In particular, in one embodiment, the pliable protective structure 26 covers spaces that would otherwise exist between keys 18 and housing 12 and prevents foreign materials from entering the interior of the housing through such spaces. Moreover, the pliable protective structure 26 provides protection for keys 18 and a substantially non-slip surface for contact with the user's fingers when the user depresses the keys to the keypad structure.

Pliable protective structure 26 is an example of protective means for covering the keypad structure and a portion of the housing and for preventing foreign material from entering the interior of the housing through the keypad structure. Moreover, bezel 22 is an example of a structure that corresponds to removable means for covering the keypad structure and the pliable protective structure and for being removed to expose the keypad structure and the pliable protective structure to facilitate cleaning of these structures.

When portable computer 10 is exposed to dirt, dust, or other adverse environmental conditions, the removable bezel 22 is removed to expose pliable protective structure 26. In this manner, keypad structure 16 can be easily wiped clean of any dirt or dust and can remove any foreign material that would otherwise be trapped within the keypad structure of the computer. Moreover, pliable protective structure 26 seals the interior of housing 12 such that water or other cleaning agents do not enter the interior of housing 12 and potentially damage the processing components of computer 10.

The foregoing selectively removable bezels can be used with portable electronics devices that have any type of display device, housing, or expansion ports and, indeed, can be used with portable electronics devices that have no display device or expansion ports. Thus, the invention can be practiced with or without the other novel structures disclosed hereinafter, including the selectively disabled touch sensitive screen, the expansion port, and the ergonomic features of the housing. However, including some or all of these other novel structures in addition to the removable bezel can result in a portable electronics device that can be both held comfortably and conveniently used in adverse environmental conditions. Thus, the description will now proceed to these additional novel features.

2. Touch Sensitive Screen

Figure 4:
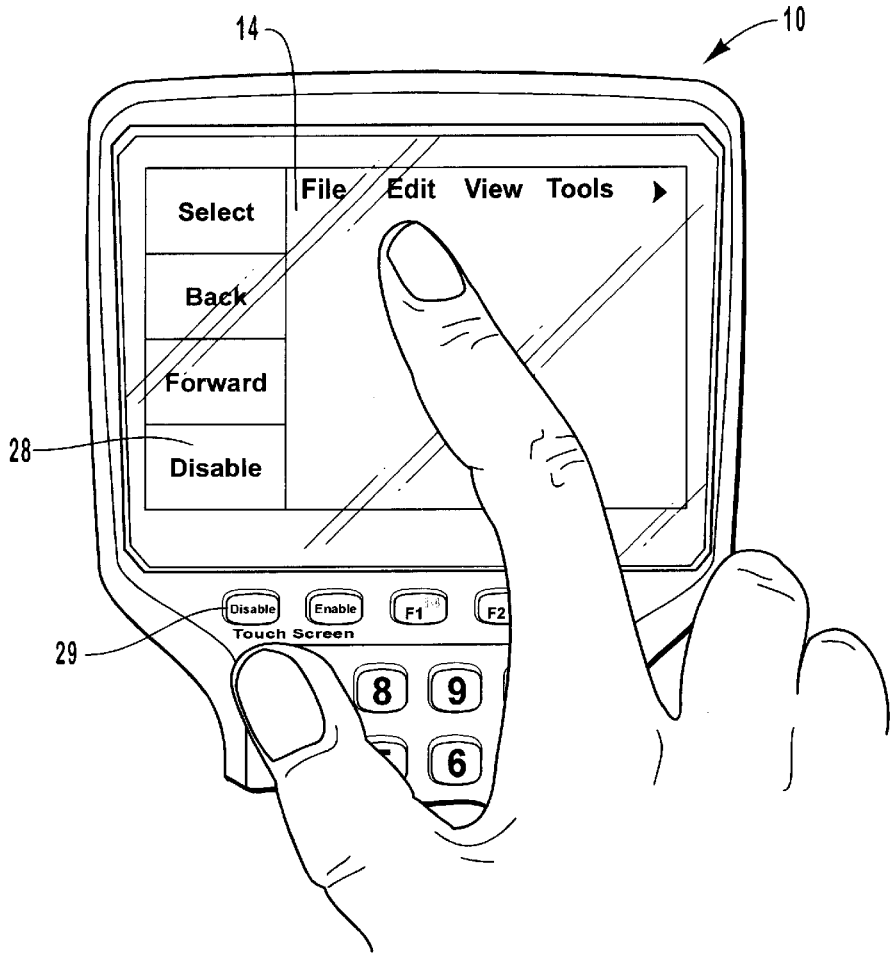
FIG. 4 illustrates a touch sensitive screen associated with the handheld computer, wherein the touch sensitive screen can be selectively disabled to facilitate cleaning of the screen.

FIG. 4 illustrates a touch sensitive screen, the touch sensitivity of which can be selectively disabled to permit the user to clean the touch sensitive screen without causing input to be inadvertently entered to computer 10. Touch sensitive screen 14 can be any desired touch sensitive screen, including those that are currently used in consumer electronics devices. Touch sensitive screen 14 can be used in combination with or in place of a keypad structure. While touch sensitive screens are one of the most intuitive forms of input devices, conventional touch sensitive screens can be cleaned only when the entire electronics device or the entire display device is disabled or powered down.

Rather than requiring the entire computer 10 or the entire display device to be disabled or powered down, only the touch sensitivity of screen 14 is disabled. Thus, when computer 10 is exposed to dust, dirt, water, or other adverse environmental conditions, and the user wishes to wipe or clean off screen 14, the user can merely disable the touch sensitivity of the screen prior to cleaning. Once the touch sensitivity is disabled, the user can clean the screen 14 using a hand or any object as desired without the risk of applying pressure to screen 14 that would cause input to be inadvertently entered to computer 10. Moreover, because the entire computer 10 or the entire display device is not disabled, the user can continue to view information on screen 14 while the touch sensitivity of the screen is disabled. In this manner, users can find that the screen can be cleaned more quickly and more conveniently than has been possible in conventional devices. After the user has cleaned screen 14 as desired, the touch sensitivity of the screen can be re-enabled so that the screen can again be used as an input device.

Disabling the touch sensitivity of screen 14 can be performed in one of a variety of ways. For instance, touch sensitive screen 14 can include a pressure sensitive region and an associated portion of a displayed image 28 that, when touched, responds by disabling the touch sensitivity. Alternatively, a key 29 located in a keypad structure or any other position on computer 10 can be used to disable the touch sensitivity of screen 14. Those skilled in the art will recognize that there are a variety of structures that can be used to receive input from the user requesting that the touch sensitivity be enabled or disabled. Computer 10 includes hardware circuitry, software logic, or a combination thereof that responds to input requesting enablement and disablement of the touch sensitivity. For example, a hardware mechanism for disabling the touch sensitivity can cause electrical signals generated by touch sensitive screen 14 to not be generated, can cause the screen to not react to pressure, or can interfere with such electrical signals such that computer 10 fails to respond thereto. Software mechanisms can interfere with the ability of software associated with touch sensitive screen 14 to operate in response to pressure or can cause other software operating on computer 10 (i.e., operating systems, applications) to fail to respond to signals generated by the screen. Thus, "disabling" touch sensitivity, as used herein, refers to acts associated with causing touch sensitive screen 14 to fail to respond to applied pressure and also refers to acts associated with causing computer 10 to not respond to input signals generated by touch sensitive screen 14. Those skilled in the art will recognize, upon learning of the disclosure made herein, that other mechanisms and structures for disabling touch sensitivity can be used.

3. Ergonomic Features of Housing

Figure 5:
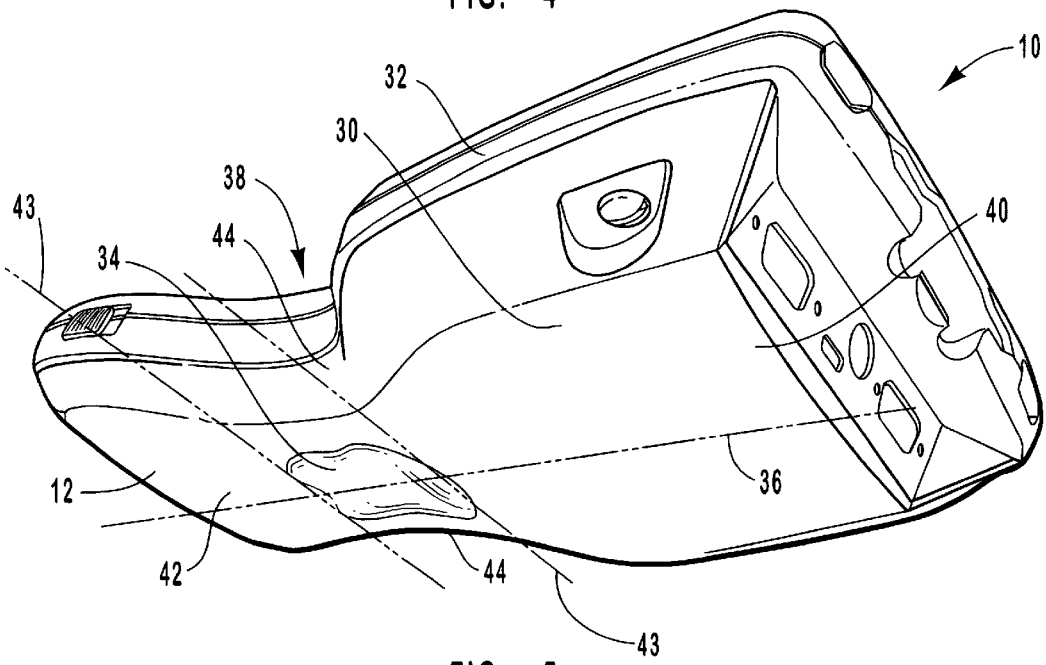
FIG. 5 is a back perspective view of the handheld computer of FIG. 1.

FIG. 5 is a back perspective view of computer 10 of FIG. 1, showing several of the ergonomic features that can allow the computer to be held comfortably by a user. FIG. 5 illustrates a back surface 30 of housing 12 and lateral surface 32. Another later surface is positioned on an opposite side of housing 12 from lateral surface 32 shown in FIG. 5. As one part of the ergonomic features, back surface 30 has formed therein a shallow depression 34 for engaging the fingers portions of the palm of a hand of a user who holds computer 10. Depression 34 can take any of a variety of shapes, so long as the user's fingers or a portion of the palm can be received therein or can grip housing 12 in the depression. In the embodiment illustrated in FIG. 5, depression 34 has an oblong shape with the major axis aligned with the longitudinal axis of computer 10 and situated at the midline 36 of housing 12. A depression 34 having this position and shape enables the computer 10 to be held equally well with either hand and permits several fingers to potentially grip housing 12 within depression 34. In another embodiment, depression 34 takes the form of elongate channel formed on back surface 12 along midline 36, which also enables the fingers or the palm of the hand to grip the housing.

FIG. 5 also illustrates how housing 12 and the body of computer 10 can be described conceptually in terms of three regions or sections, which together form a unitary or integrated device. In particular, housing 12 can be described as having a middle gripping region 38 positioned between a top section 40 and a bottom section 42. As shown in FIG. 5, the conceptual boundaries between these portions 38, 40, and 42 can be generally defined by dotted lines 43, which are presented for illustration purposes. Middle gripping region 38 can be narrower than the adjacent top section 40 and bottom section 42, so that the user's hand does not tend to slip upwards or downwards away from gripping region 38.

Yet another ergonomic feature of this embodiment relates to rounded corners 44 at the portion of housing 12 where lateral surfaces 32 meet back surface 30. Rounded comers 44, in contrast to relatively sharp comers of housings found in other portable electronics devices, allow computer 10 to be comfortably held in a user's hand or hands for extended periods of time without causing discomfort.

Other ergonomic features, in addition to those described above in reference to FIG. 5, are illustrated in FIG. 1. For instance housing 12 can have rounded corners 60 where front surface 20 and lateral surface 32 meet. These rounded comers further enhance the comfort of the user when computer 10 is held for extended periods of time.

Figure 8:
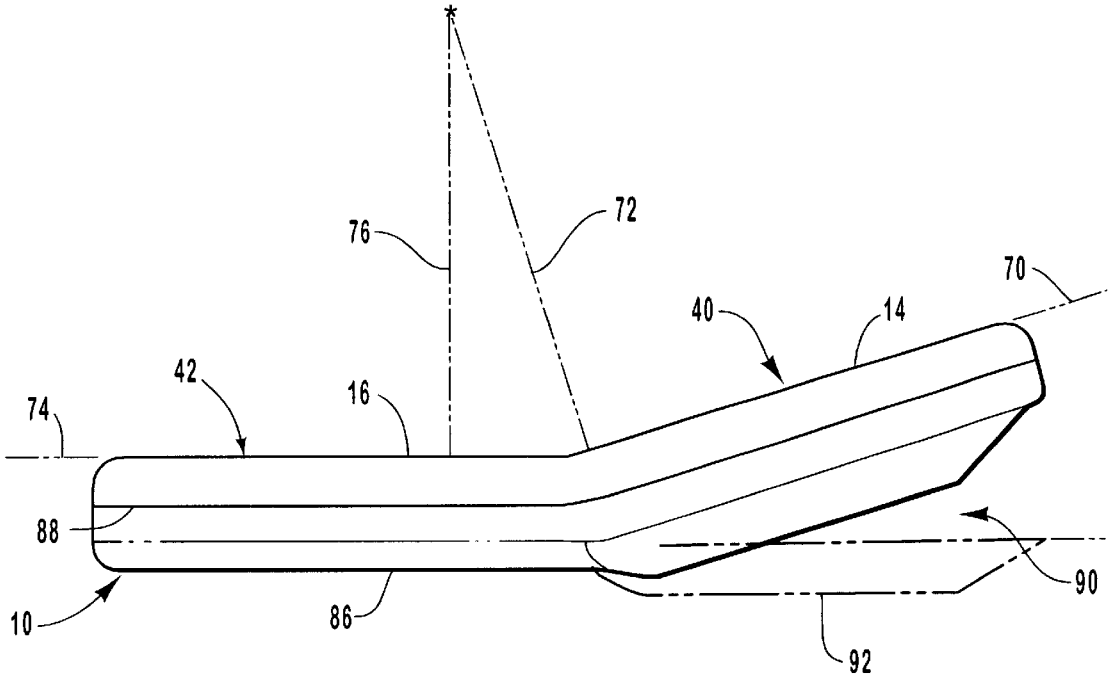
FIG. 8 is a side view of the handheld computer of FIG. 1, showing the angular position of the screen with respect to the keypad structure.

Another ergonomic feature of computer 10 according to one embodiment is the angular position of screen 14 with respect to the position of the remainder of front surface 20, as illustrated in FIG. 8, which is a side view of computer 10. In this embodiment, the screen, the position of which is indicated by reference number 14, defines a plane 70 and a line 72 normal thereto that extends away from screen 14. Similarly, the keypad structure, the position of which is indicated by reference number 16, defines another plane 74 and a line 76 normal thereto that extends away from the keypad structure 16. Rather than the plane 74 defined by keypad structure 16 and the plane 70 defined by screen 14 being coplanar or parallel, these two planes are angularly displaced relative to one another. Stated another way, the two normal lines 76 and 72 are nonparallel and can intersect one with another at a position above keypad structure 16.

The result of the geometry illustrated in FIG. 8 is that screen 14 is tilted upwards from the plane 74 defined by keypad structure 16 so that it can be more easily viewed by the user while the user hold computer 10. Positioning screen 14 in this manner avoids the situation where the user is required to repeatedly rotate the wrist as the user alternates between using keypad structure 16 and viewing screen 14. Moreover, the user can simultaneously view screen 14 and use keypad structure 16, with both being in a comfortable position.

Figure 6A:
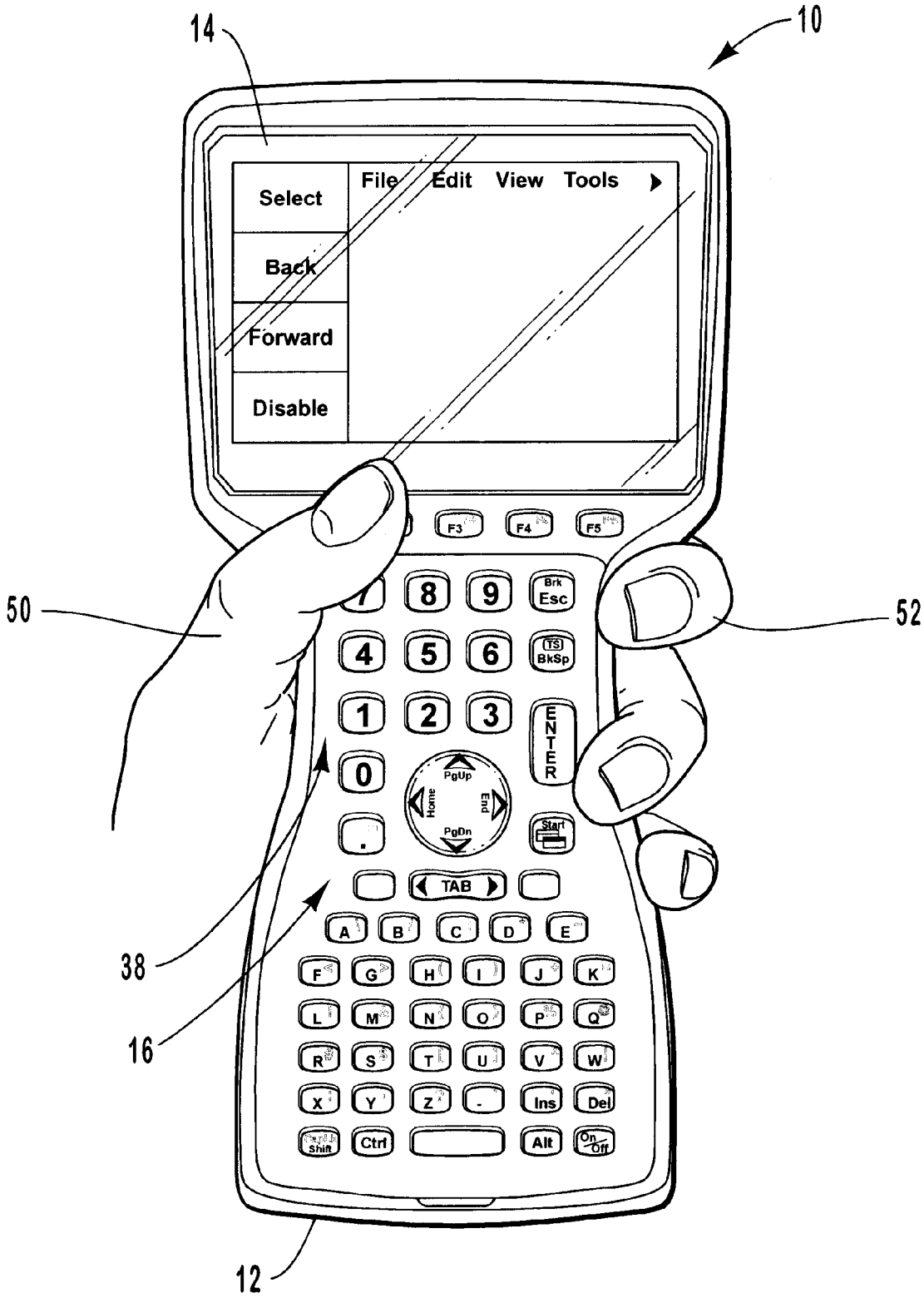
FIG. 6A shows a user holding the handheld computer of FIG. 1 using one hand in a first grip.
Figure 6B:
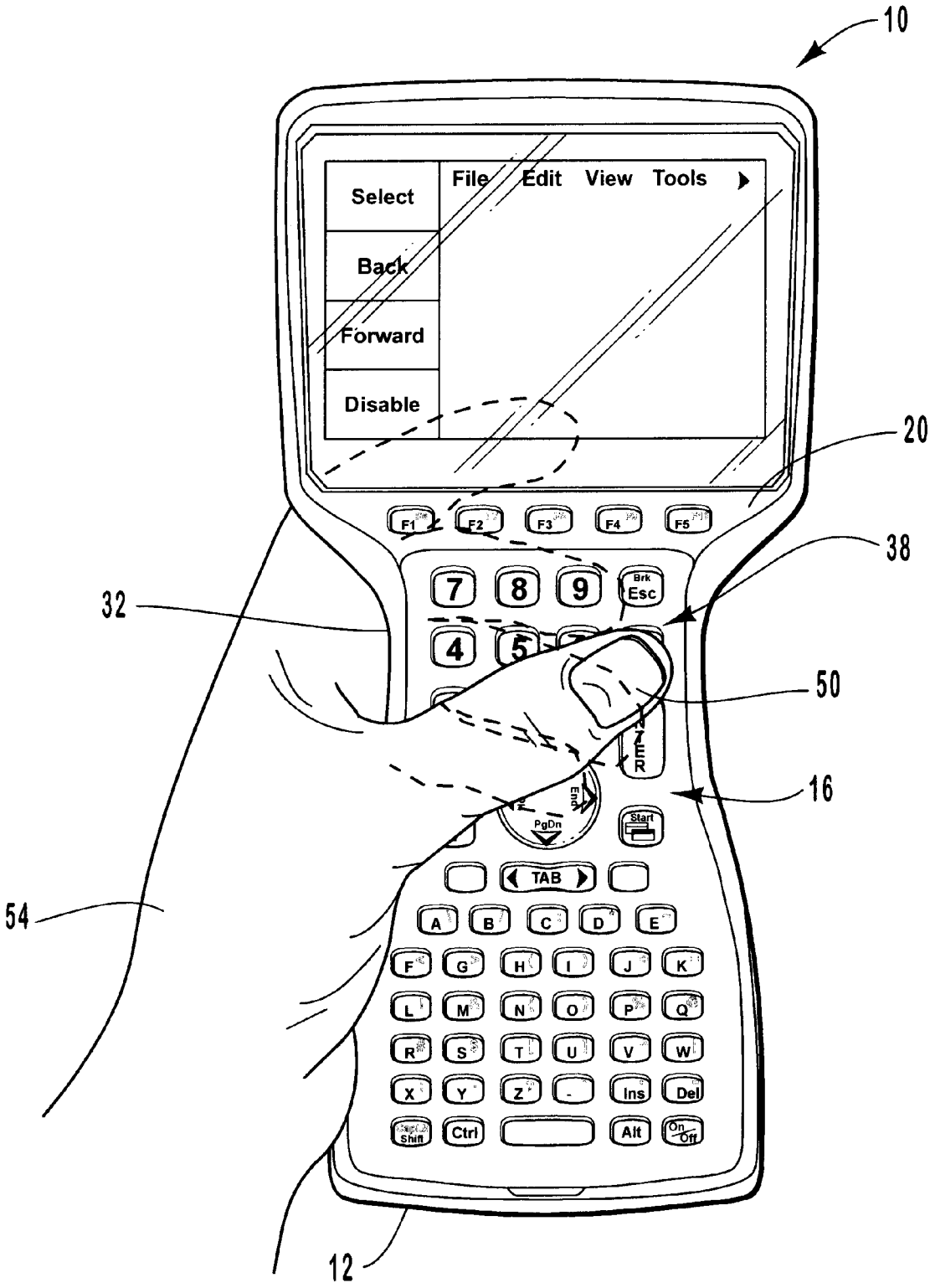
FIG. 6B illustrates a user holding the handheld computer of FIG. 1 using one hand in a second grip.
Figure 6C:
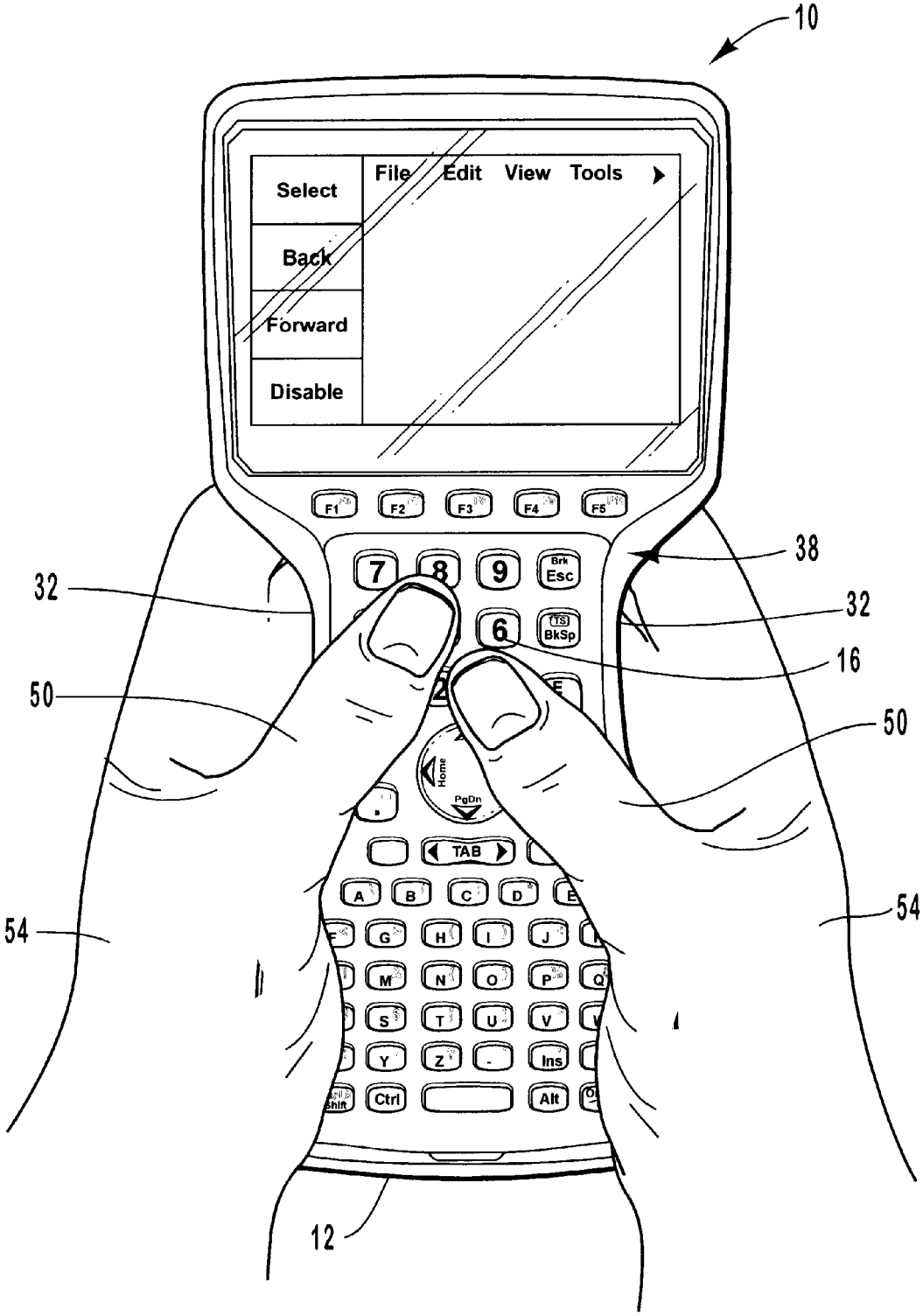
FIG. 6C illustrates a user holding the handheld computer of FIG. 1 using two hands in a third grip.

FIGS. 6A–6C illustrate computer 10 of FIG. 5 being held by a user in three different positions that take advantage of the shape of housing 12. These three positions are not exhaustive of the ways in which a user can hold computer 10, but do illustrate that the user can shift between positions and can select a position according to the particular task that is being performed with computer 10. FIGS. 6A–6C also illustrate other ergonomic features of computer 10.

Turning first to FIG. 6A, the user is grasping the gripping region 38 of housing 12 with one hand, with the upper portion of the palm being positioned on the depression of the back surface. For instance, the depression 34, shown in FIG. 5, can engage the rounded portion of the palm that is opposite the knuckles of the fingers, particularly the index and middle fingers. Positioning this portion of the palm of hand in the depression inhibits slippage of housing 12 with respect to the user's hand.

As further illustrated in FIG. 6A, fingers 52 are wrapped around one lateral surface of gripping region 38 and thumb 50 is wrapped around the other lateral surface. With the hand in this position, the user can view screen 14 and to have the other hand free to enter information into the keypad structure 16 or to engage in other activities.

FIG. 6B illustrates computer 10 being grasped by the user with one hand in another position. In this position, one or more of the fingertips or another portion of the fingers are positioned in the depression on the back surface of housing 12. Positioning the fingertips or another portion of the fingers within the depression in this manner allows the user to firmly grasp computer 10. The center portion of the palm is positioned at lateral surface 32 of gripping portion 38 as illustrated in FIG. 6B, with the thumb of the hand and the nearby portions of the palm being positioned at or near the front surface 20. This position enables the user to have one free hand and to enter data to keypad structure 16 using the free hand or thumb 50 of hand 54.

FIG. 6C illustrates a user grasping computer 10 using two hands. In this position, the fingertips or another portion of one of more fingers of both hands 54 engage the depression on the back surface of housing 12. Portions of the palms of the hands rest on the lateral surfaces 32 of gripping section 38. Both thumbs 50 are positioned on or over keypad structure 16 and are available to depress keys 18 to enter information into computer 10. Using both thumbs 50 enables faster keying of data than is possible using only one thumb 50. This position also allows the user to grasp computer 10 in a highly secure manner while simultaneously enter information into the computer.

4. Expansion Port

Figure 7:
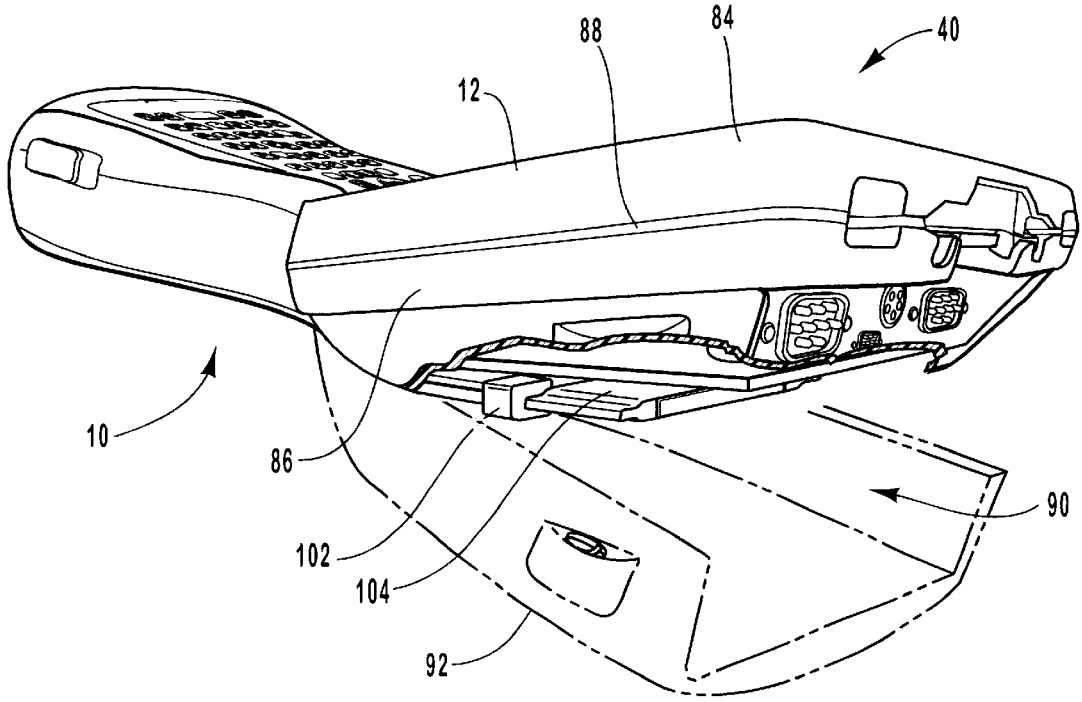
FIG. 7 is a perspective view of the handheld computer of FIG. 1 showing an expansion port in relation to a sealed interface between a front portion and a back portion of the housing.

FIGS. 7 and 8 illustrate one embodiment of computer 10 having an expansion port that accepts expansion cards, peripheral devices, communication devices, or any other structure that currently exists or that will be developed in the future to enhance the capabilities of computer 10. In FIGS. 7 and 8, computer 10 is a rugged portable computer that has features adapted to protecting processing components housed in housing 12 from adverse conditions, dirt, water, dust, etc. Housing 12 is formed from a front portion 84 and a back portion 86 that are connected at or by a gasket or another sealing structure at seal 88. In order to enhance the watertight nature of seal 88, the associated gasket can be formed of a pliable material that conforms to both front portion 84 and back portion 86. As shown in FIGS. 7 and 8, seal 88 and the associated gasket do not lie in a single plane, but are displaced upwards in the portion of seal 88 that is included in the top section 40 of computer 10.

Seal 88 is positioned so that an expansion port, which is shown generally at reference number 90, can be formed in top section 40 without straddling or interfering with the integrity or the operation of seal 88 and the associated gasket or other sealing structure. In this embodiment, expansion port 90 is positioned within back portion 86 of housing 12 and behind seal 88. Expansion port 90 is exposed when door 92 is opened (as shown by the phantom lines), thereby allowing an expansion device to be inserted into expansion port 90.

Positioning seal 88 and expansion port 90 in the manner depicted in FIGS. 7 and 8 allows computer 10 to be a rugged, substantially watertight computer that can be used in a variety of environmental conditions without being damaged. Moreover, seal 88 and the associated gasket can be relatively simple compared to that which would be necessary if expansion port 90 were to be aligned with, straddle, or interfere with the gasket.

While the location of the expansion port is shown generally at reference number 90, a specific example of hardware associated with an expansion port is illustrated in FIG. 7, which depicts a user-accessible PC card slot 102 and a card 104 having been inserted therein. Card 104 can be mass data storage, an input/output device, or any other expansion device that enhances the capabilities of computer 10, thereby enabling computer 10 to take advantage of any of a variety existing or future technologies. For instance, computer 10 can be fitted with a global positioning system receiver, a laser bar code scanner, telecommunication devices, or any other such devices.

It should be appreciated that as computer 10 is fitted with various hardware components that the shape and size of door 92 can be modified accordingly to accommodate the storage and configuration requirements of the various hardware components. By modifying the design of door 92, expansion port 90 is likewise modified, enabling various expansion devices to be inserted into expansion port 90 without affecting the watertight nature of seal 88. It should also be appreciated that door 92 can be configured so as to be selectively removable and replaceable with alternative embodiments of door 92 in order to accommodate the various storage space requirements of current and future expansion device technologies.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An electronics device that can be conveniently cleaned, comprising:

a housing;

a keypad structure including keys positioned at a surface of the housing;

a pliable protective structure that covers and substantially conforms to the keys and to the surface, the pliable protective structure sealing an interior of the housing to prevent material from entering the interior of the housing; and a bezel removably positioned over the keypad structure, the bezel having openings through which the keys extend, the bezel being removable to permit the keypad structure to be cleaned, wherein the pliable protective structure seals the interior of the housing when the bezel is removed.

2. The electronics device as recited in claim 1, wherein the keys are positioned at the surface of the housing such that spaces extending into an interior of the housing exist between the keys and the housing, the pliable protective structure further covering the spaces.

3. The electronics device as recited in claim 1, wherein the pliable protective structure comprises a pliable material such that the keys can be depressed through the pliable protective structure.

4. The electronics device as recited in claim 3, wherein the pliable material comprises a polymeric material.

5. The electronics device as recited in claim 1, wherein the pliable protective structure is attached to the housing such that the pliable protective structure and the housing substantially prevent foreign material from entering the interior of the housing through the keypad structure.

6. The electronics device as recited in claim 1, wherein the bezel has printed thereon at least one of lettering and numbering.

7. An electronics device that can be conveniently cleaned, comprising:

a housing having a front surface;

a keypad structure including keys positioned at the front surface of the housing;

a pliable protective structure formed from a polymeric material, the pliable protective structure covering and substantially conforming to the keys and to a portion of the front surface such that the keys can be depressed through the pliable protective structure and an interior of the housing is sealed from an exterior of the housing; and a bezel removably positioned over the keypad structure, the bezel having openings through which the keys extend, the bezel being removable to permit the pliable protective structure to be cleaned, wherein a keypad surface including a front surface of the bezel and a portion of the pliable protective structure that covers the ends of the keys is presented to a user and the pliable protective structure seals the interior of the housing when the bezel is removed.

8. The electronics device as recited in claim 7, wherein the bezel is formed from a substantially rigid material.

9. The electronics device as recited in claim 7, wherein the pliable protective structure covers the keys to the extent that the keypad structure is substantially watertight such that water cannot enter the interior of the housing through the keypad structure.

10. The electronics device as recited in claim 7, wherein the pliable protective structure and the housing are sealingly engaged about a periphery of the keypad structure.

11. An electronics device having a keypad that can be conveniently cleaned, comprising:

housing means for defining and enclosing an interior of the electronics device;

key means for generating input to the electronics device upon being manipulated by a user;

protective means for covering the key means and a portion of the housing means and for sealing the interior of the housing means to prevent foreign material from entering the interior through the key means; and removable means for covering the key means and the protective means and for being removed to expose the key means and the protective means to facilitate cleaning of the key means and the protective means, wherein the protective means seals the interior of the housing when the removable means is removed; and wherein the removable means comprises a bezel removably attached to the housing means, the bezel having an array of holes through which the key means extend when the bezel is attached to the housing means.

12. The electronics device as recited in claim 11, wherein the housing means comprises a housing having a front portion and a back portion having a sealed interface therebetween.

13. The electronics device as recited in claim 11, wherein the protective means comprises a protective pliable structure formed from a polymeric material.

* * * * *